US009074320B2

(12) United States Patent
Gomi

(10) Patent No.: US 9,074,320 B2
(45) Date of Patent: Jul. 7, 2015

(54) SHEET MANUFACTURING APPARATUS AND SHEET MANUFACTURING METHOD

(71) Applicant: SEIKO EPSON CORPORATION, Tokyo (JP)

(72) Inventor: Katsuhito Gomi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,407

(22) Filed: Sep. 15, 2014

(65) Prior Publication Data

US 2015/0096706 A1 Apr. 9, 2015

(30) Foreign Application Priority Data

Oct. 3, 2013 (JP) ..... 2013-207968

(51) Int. Cl.
*D21F 3/08* (2006.01)

(52) U.S. Cl.
CPC ..... *D21F 3/08* (2013.01)

(58) Field of Classification Search
USPC ..... 162/358.1, 115; 399/322, 324, 401
See application file for complete search history.

(56) References Cited

U.S. PATENT DOCUMENTS 5,422,710 A * 6/1995 Shirasaka et al. ..... 399/322
5,774,204 A * 6/1998 Suzuki et al. ..... 355/27
6,243,558 B1 * 6/2001 Oota ..... 399/326
7,386,268 B2 * 6/2008 Terashima ..... 399/401
2006/0067736 A1 * 3/2006 Kim et al. ..... 399/167
2010/0054787 A1 * 3/2010 Nagai et al. ..... 399/69
2011/0076067 A1 * 3/2011 Nagai et al. ..... 399/322
2011/0217100 A1 * 9/2011 Yoshikawa ..... 399/342
2014/0027075 A1 1/2014 Yamagami et al.
2014/0374047 A1 12/2014 Yamagami

FOREIGN PATENT DOCUMENTS

JP 53-038785 B 10/1978
WO 2012/095928 A1 7/2012

OTHER PUBLICATIONS

Extended European Search Report for European Patent Application No. 14187602.9 dated Feb. 18, 2015.

* cited by examiner

*Primary Examiner* — Mark Halpern
(74) *Attorney, Agent, or Firm* — Global IP Counselors, LLP

(57) ABSTRACT

A sheet manufacturing apparatus includes a web forming unit configured to form a web which includes fibers and resin, and a first pressurizing unit and a second pressurizing unit configured to pressurize the web. The first pressurizing unit has a separation layer, is positioned on an upstream side of the second pressurizing unit in a transfer direction of the web, and is configured to heat the web. The second pressurizing unit is positioned on a downstream side of the first pressurizing unit in the transfer direction of the web, does not have a separation layer, and is configured not to heat the web. The pressurizing force from the first pressurizing unit is smaller than the pressurizing force from the second pressurizing unit.

4 Claims, 2 Drawing Sheets

SHEET MANUFACTURING APPARATUS AND SHEET MANUFACTURING METHOD

CROSS-REFERENCE TO RELATED APPLICATIONS

This application claims priority to Japanese Patent Application No. 2013-207968 filed on Oct. 3, 2013. The entire disclosure of Japanese Patent Application No. 2013-207968 is hereby incorporated herein by reference.

BACKGROUND

1. Technical Field

The present invention relates to a sheet manufacturing apparatus and a sheet manufacturing method.

2. Related Art

In the prior art, there is known a sheet manufacturing apparatus where a sheet is formed by a transfer medium, where additives and reinforcing materials are added to pulp fibers, being supplied on a mesh and passed through between heating rollers after a polymer emulsion is sprayed on as a binder (for example, refer to Japanese Examined Patent Application Publication No. S53-38785).

Here, there is a problem in that the transfer medium becomes attached to a heating and pressurizing unit when the transfer medium is heated and pressurized. This is because resin such as thermoplastic resin or thermosetting resin melts due to heating and become adhered to the heating and pressurizing unit when further pressurized. As a countermeasure, a configuration is considered where a separation layer is provided at a location where the transfer medium comes into contact with the heating and pressurizing unit and the ease of separation between the heating and pressurizing unit and the transfer medium is increased. However, pressurizing is carried out at the same time as heating in the heating unit so as to come into contact with the transfer medium. Since the durability of such a separation layer is low with regard to high pressures, there is a problem in that the separation layer is damaged when repetitively performing heating and pressurizing of the transfer medium at high pressures.

SUMMARY

The present invention is carried out in order to solve a portion of the problems described above and is able to be realized as the following aspects and applied examples.

A sheet manufacturing apparatus according to the present applied example is provided with a web forming unit configured to form a web which includes fibers and resin, and a first pressurizing unit and a second pressurizing unit configured to pressurize the web. The first pressurizing unit has a separation layer, is positioned on an upstream side of the second pressurizing unit in a transfer direction of the web, and is configured to heat the web. The second pressurizing unit is positioned on a downstream side of the first pressurizing unit in the transfer direction of the web, has no separation layer, and is configured not to heat the web. A pressurizing force from the first pressurizing unit is smaller than a pressurizing force from the second pressurizing unit.

According to this configuration, the web is first pressurized by the first pressurizing unit which is arranged on the upstream side and is then pressurized by the second pressurizing unit which is arranged on the downstream side. Here, the first pressurizing unit pressurizes while heating. In addition, due to the first pressurizing unit having the separation layer, it is possible for the web to be transferred without becoming attached to the first pressurizing unit even if the web is heated and pressurized. Furthermore, since the pressurizing force with regard to the web from the first pressurizing unit is smaller than the pressurizing force from the second pressurizing unit, the durability of the separation layer is improved. Then, the pressurizing force from the second pressurizing unit on the downstream side of is larger than the pressurizing force from the first pressurizing unit and insufficient pressurizing by the first pressurizing unit is compensated for by the second pressurizing unit. In addition, it is possible for there to be no separation layer on the second pressurizing unit since the web does not become adhered to the second pressurizing unit due to no heating being carried out. It is possible for high pressures to be endured since there is no separation layer. Here, the first pressurizing unit and the second pressurizing unit both pressurize the web and hence come into contact with the web.

In the sheet manufacturing apparatus according to the applied example described above, the first pressurizing unit has a plurality of pairs of heating rollers in the transfer direction of the web, and a pressurizing force relative to the web from the heating rollers on the downstream side is larger than the pressurizing force relative to the web from the heating rollers on the upstream side.

According to this configuration, since the pressurizing force from the heating rollers on the downstream side larger than the pressurizing force from the heating rollers on the upstream side, it is possible to suppress stretching of the web by gradually pressurizing and heating the web over a plurality of times.

The separation layer of the sheet manufacturing apparatus according to the applied example described above is a layer which includes fluorine.

According to this configuration, it is possible to easily configure the separation layer which does not become attached to the web by including fluorine.

The sheet manufacturing apparatus according to the applied example described above has a cutting unit configured to cut the web on the upstream side of the first pressurizing unit in the transfer direction.

It is easy for a front end portion of the web to be wound around the pressurizing and heating unit since the front end portion of the web is not pressed down. Since, in a configuration where the web with a continuous form becomes webs with sheet shapes due to the cutting unit, front end portions are generated for each of the sheet shapes, the effect is particularly exhibited in this configuration.

A sheet manufacturing method according to the present applied example includes forming a web which includes fibers and resin using a web forming unit, heating and pressurizing the web, which has been formed, using a first pressurizing unit which has a separation layer, and pressurizing the web, which is heated by the first pressurizing unit, with a pressurizing force which is larger than the pressurizing force from the first pressurizing unit, without heating using a second pressurizing unit which has no a separation layer.

According to this configuration, the web is first pressurized by the first pressurizing unit which is arranged on the upstream side and is then pressurized by the second pressurizing unit which is arranged on the downstream side. Here, the first pressurizing unit pressurizes while heating. In addition, due to the first pressurizing unit having the separation layer, it is possible for the web to be transferred without becoming attached to the first pressurizing unit even if the web is heated and pressurized. Furthermore, since the pressurizing force with regard to the web from the first pressurizing unit is smaller than the pressurizing force from the second pressurizing unit, the durability of the separation layer is improved. Then, the pressurizing force from the second pressurizing unit on the downstream side is larger than the pressurizing force from the first pressurizing unit and insufficient pressurizing by the first pressurizing unit is compensated for by the second pressurizing unit. In addition, it is possible for there to be no separation layer on the second pressurizing unit since the web does not become adhered to the second pressurizing unit due to no heating being carried out. It is possible for high pressures to be endured since there is no separation layer.

In the sheet manufacturing method according to the applied example described above, the web passes through the second pressurizing unit at a temperature which is higher than a temperature of surroundings of the second pressurizing unit.

According to this configuration, it is possible for the web to be thin by reliability bonding and pressurizing resin and fibers by cooling the web by the temperature of the web remaining in a state of being high to a certain extent due to the first pressurizing unit and the web being passed through the second pressurizing unit without heating in a state where resin is melted.

BRIEF DESCRIPTION OF THE DRAWINGS

Referring now to the attached drawings which form a part of this original disclosure.

DETAILED DESCRIPTION OF EXEMPLARY EMBODIMENTS

An embodiment of the present invention will be described below with reference to the drawings. Here, the dimensions of each member and the like are shown as different to the actual dimensions in each of the following diagrams in order for each member and the like to be a size which is visually recognizable.

First, the configuration of a sheet manufacturing apparatus will be described. The sheet manufacturing apparatus is based on a technique where, for example, a raw material (material to be defibrated) Pu such as a fresh pulp sheet or used paper is formed into a new sheet Pr. The sheet manufacturing apparatus according to the present embodiment is provided with a web forming unit which forms a web which includes fibers and resin and a plurality of pressurizing units which pressurize the web and the sheet manufacturing apparatus is configured so that a first pressurizing unit on the upstream side in the transfer direction of the web has a separation layer and heats the web, a second pressurizing unit on the downstream side in the transfer direction of the web does not have a separation layer and does not heat the web, and the pressurizing force from the first pressurizing unit is smaller than the pressurizing force from the second pressurizing unit. In addition, a sheet manufacturing method according to the present embodiment includes forming a web which includes fibers and resin using the web forming unit, heating and pressurizing the web which is formed using the first pressurizing unit which has a separation layer, and pressurizing the web which is heated by the first pressurizing unit with a pressurizing force which is larger than the pressurizing force from the first pressurizing unit without heating using the second pressurizing unit which does not have a separation layer. Here, the web according to the present embodiment refers to the configuration format of an object which includes fibers and resin. Accordingly, a case where the format such as the dimensions changes during heating, pressurizing, cutting, transferring, or the like of the web is included as the web. The configuration of the sheet manufacturing apparatus will be described in detail below.

Figure 1:
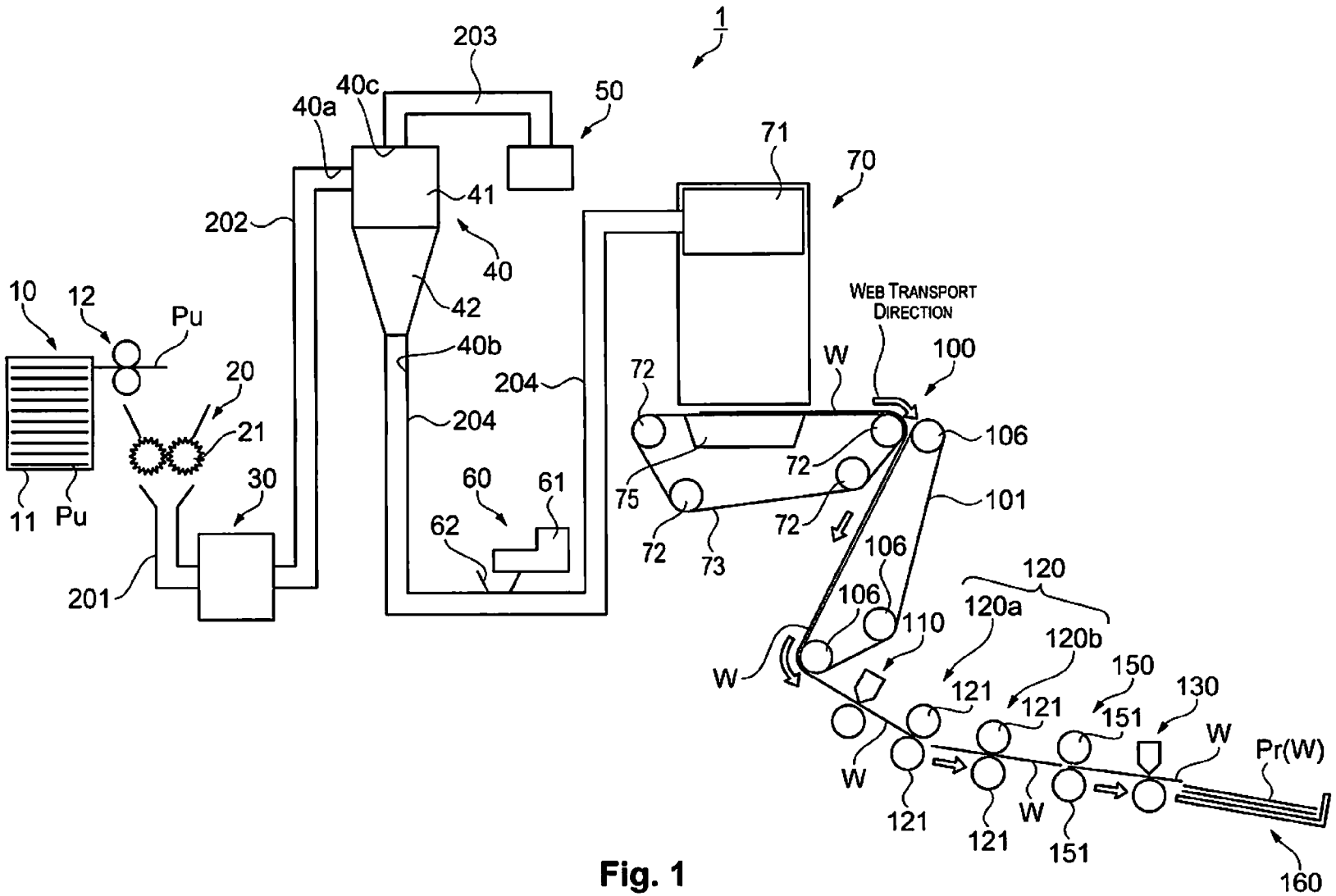
FIG. 1 is a schematic diagram illustrating a configuration of a sheet manufacturing apparatus.
Figure 2:
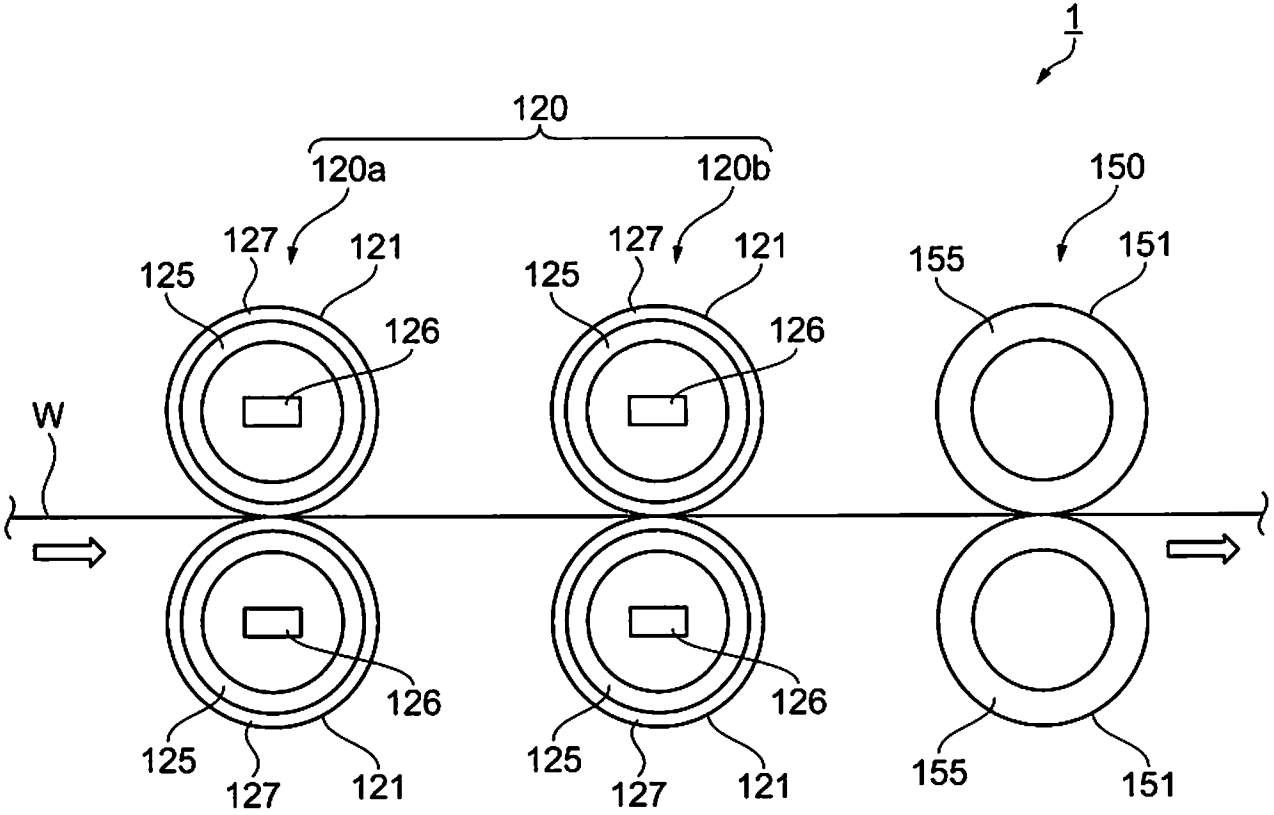
FIG. 2 is a schematic diagram illustrating a portion of a configuration of a sheet manufacturing apparatus.

FIG. 1 is a schematic diagram illustrating the configuration of the sheet manufacturing apparatus. FIG. 2 is a schematic diagram illustrating a portion of the configuration of the sheet manufacturing apparatus. As shown in FIG. 1, a sheet manufacturing apparatus 1 is provided with a supplying unit 10, a crushing unit 20, a defibrating unit 30, a classifier unit 40, a receiving unit 50, an additive agent feeding unit 60, a web forming unit 70, a transferring unit 100, a plurality of pressurizing units 120, and the like. Furthermore, a cutting unit 110 and the like are provided in the present embodiment.

The supplying unit 10 supplies used paper Pu to the crushing unit 20. The supplying unit 10 is provided with, for example, a tray 11 where a plurality of sheets of the used paper Pu are stacked, an automatic sending mechanism 12 where the used paper Pu in the tray 11 is able to be continuously fed into the crushing unit 20. As the used paper Pu which is supplied to the sheet manufacturing apparatus 1, there is, for example, sheets of A4 size paper and the like which is currently in mainstream use in offices.

The crushing unit 20 cuts the used paper Pu which is supplied into pieces of paper which are squares of several centimeters. A crushing blade 21 is provided in the crushing unit 20 and an apparatus is configured such that the cutting width of the blade of a normal shedder is widened. Due to this, it is possible to easily cut the used paper Pu which is supplied into pieces of paper. Then, the crushed paper which is cut up is supplied to the defibrating unit 30 via a pipe 201.

The defibrating unit 30 is provided with a rotating blade which rotates (which is not shown in the diagram) and disentangles and defibrates the crushed paper which is supplied from the crushing unit 20 into a fibrous state. Here, the defibrating unit 30 of the present embodiment performs defibrating in air with a dry type. Due to a defibrating process using the defibrating unit 30, paper coating materials such as printing ink or toner or a stain preventing material become particles of several tens of μm or less (referred to below as "ink particles") and are defibrated with the fibers. Accordingly, the defibrated material which is output from the defibrating unit 30 is fibers and ink particles which are obtained due to defibrating the pieces of paper. Then, there is a mechanism where a flow of air is generated by the rotation of the rotating blade and fibers which are defibrated are transferred to the classifier unit 40 via a pipe 202 due to being caught by the flow of air. Here, in a case of using the defibrating unit 30 with a dry type where a wind generating mechanism is not provided, it is sufficient if an air flow generating apparatus, which generates a flow of air from the crushing unit 20 to the defibrating unit 30, is separately provided.

The classifier unit 40 classifies the defibrated material into ink particles and fibers. In the present embodiment, a cyclone is applied as the classifier unit 40 (the classifier unit will be described below as the cyclone 40) and the fibers which are being transferred are classified using the flow of air into ink particles and deinked fibers (deinked defibrated material). Here, another type of classifier device with an air flow system may be used instead of the cyclone 40. In this case, for example, an elbow jet, an eddy classifier, or the like may be used as the classifier device with an air flow system other than the cyclone 40. The classifier device with an air flow system generates a revolving flow of air and, by separating and classifying using differences in centrifugal force which is received according to the size and density of the defibrated material, it is possible to adjust the classifying points by adjusting the speed or centrifugal force of the air flow. Due to this, ink particles which are comparatively small and have a low density and fibers which are larger and have a higher density than ink particles are divided up. Removing of ink particles from fibers is referred to as deinking.

Here, the cyclone 40 has a relatively simple structure as a tangential input type of cyclone. The cyclone 40 of the present embodiment is configured from an introduction port 40*a* with introduction from the defibrating unit 30, a cylindrical unit 41 which is joined to the introduction port 40*a* in the tangential direction, a conical unit 42 which is continuous with a lower section of the cylindrical unit 41, a lower output port 40*b* which is provided at a lower section of the conical unit 42, and an upper exhaust port 40*c* for discharging fine particles which is provided in the center of an upper section of the cylindrical unit 41. The diameter of the conical unit 42 becomes smaller heading downward in the vertical direction.

In a classifying process, the flow of air, which catches the defibrated materials which are introduced from the introduction port 40*a* of the cyclone 40, is changed to a circular action by the cylindrical unit 41, a centrifugal force is applied, fibers become increasingly entangled and are moved to the conical unit 42 due to interaction with the flow of air. In addition, ink particles which are separated are lead out to the upper exhaust port 40*c* as fine particles along with air and there is progress in deinking. Then, a mixture of short fibers which includes a large amount of ink particles is discharged from the upper exhaust port 40*c* of the cyclone 40. Then, the discharged mixture of short fibers which includes a large amount of ink particles is recovered by the receiving unit 50 via a pipe 203 which is connected with the upper exhaust port 40*c* of the cyclone 40. On the other hand, deinked fibers are transferred from the lower output port 40*b* of the cyclone 40 toward the web forming unit 70 via a pipe 204. Here, the deinked fibers may be sucked in from the upper exhaust port 40*c*.

In addition, the additive agent feeding unit 60, which adds additive agents such as resins (for example, a fusion-bonded resin or a thermosetting resin) with regard to the deinked fibers which are transferred, is provided within the pipe 204 which transfers the deinked fibers from the cyclone 40 to the web forming unit 70. Here, it is possible for, for example, a fire retarding agent, a coloring agent, a sheet strength reinforcing agent, a sizing agent, and the like to be fed in as an additive agent along with fusion-bonded resins. These additive agents are retained in an additive agent retaining unit 61 and are fed in from a feeding port 62 using a feeding mechanism which is not shown in the diagram.

The web forming unit 70 forms the web which includes fibers and resin which are fed in from the pipe 204. The web forming unit 70 has a mechanism which uniformly disperses fibers in the air and a mechanism which accumulates the fibers which are dispersed on a mesh belt 73.

First, a forming drum 71, where fibers and resin are feed into an inner section of the forming drum 71, is arranged in the web forming unit 70 as the mechanism which uniformly disperses fibers in the air. Then, it is possible to uniformly mix the resin (additive agents) into the fibers by the forming drum 71 being driven to rotate. A screen which has a plurality of small holes is provided on the surface of the forming drum 71. In addition, a needle roller which is able to rotate is provided in an inner section of the forming drum 71 so that the fibers which are fed in float. Due to this configuration, it is possible to uniformly disperse the fibers which pass through the small holes in the air.

On the other hand, the endless mesh belt 73, where a mesh which is stretched by stretching rollers 72 (four stretching rollers 72*a* to 72*d* in the present embodiment) is formed, is arranged below the forming drum 71. Then, the mesh belt 73 moves in one direction due to driving of at least one of the stretching rollers 72.

In addition, a suction apparatus 75, which is a suction unit which generates a flow of air vertically downward through the mesh belt 73, is provided vertically below the forming drum 71 via the mesh belt 73. Using the suction apparatus 75, it is possible to suck the fibers which are dispersed in the air onto the mesh belt 73.

Then, when the fibers in a tangled state are introduced from the cyclone 40 into the forming drum 71 of the web forming unit 70, fibers and resin are untangled using the needle roller and the like. Then, the untangled fibers are passed through the screen with small holes in the surface of the forming drum 71 and are accumulated on the mesh belt 73 using suction force from the suction apparatus 75. At this time, it is possible to form a web W where fibers and resin are accumulated with a lengthwise shape due to the mesh belt 73 being moved in one direction. The web W is formed with a continuous shape by dispersing from the forming drum 71 and moving of the mesh belt 73 being continuously performed. Here, the mesh belt 73 may be made of metal, resin, or nonwoven material and the mesh belt 73 may be any type of belt as long as fibers are accumulated and a flow of air passes through. Here, fibers enter in between the mesh and there are irregularities when the web (sheet) is formed if the diameter of the holes in the mesh of the mesh belt 73 is too large, and on the other hand, it is difficult to form a stable flow of air using the suction apparatus 75 if the diameter of the holes in the mesh are too small. As a result, it is preferable for the diameter of the holes in the mesh to be appropriately adjusted. It is possible to configure the suction apparatus 75 so that a closed box is formed with a window with a desired size opened below the mesh belt 73, air is sucked in from a location other than the window, and there is a negative pressure in the box compared to the outside air.

The web W which is formed on the mesh belt 73 is transferred using the transferring unit 100. The transferring unit 100 in the present embodiment performs a transfer process for the web W from the mesh belt 73 until a sheet Pr (the web W) is finally feed into the stacker 160. Accordingly, a transfer belt 101, various types of rollers, and the like which will be described later function as a portion of the transferring unit 100 along with the mesh belt 73. In detail, first, the web W, which is formed on the mesh belt 73 which is a portion of the transferring unit 100, is transferred according to the transfer direction (the arrows in the diagram) due to the mesh belt 73 being driven to rotate. Next, the web W is passed over to the transfer belt 101 which stretches across from the mesh belt 73 to a stretching roller 106 and is transferred according to the transfer direction (the arrows in the diagram).

A first cutting unit 110, which is a cutting unit which cuts the web W in a direction which intersects with the transfer direction of the web W which is being transferred, is arranged on the downstream side of the transfer belt 101 in the transfer direction of the web W. The first cutting unit 110 is provided with a cutter and cuts the web W with a continuous shape into sheet shapes according to a cutting position which is set to a predetermined length. Due to this, the web W changes from a continuous shape to sheet shapes and it is possible to reduce skew or the like being generated due to transferring of the web W since the length dimension of the web W is shorter in the transfer direction.

Then, a plurality of pressurizing units are arranged on the downstream side of the first cutting unit 110 in the transfer direction of the web W. In the present embodiment, a first pressurizing unit 120 and a second pressurizing unit 150 are arranged as the plurality of pressurizing units. Then, the first pressurizing unit 120 is arranged on the upstream side in the transfer direction of the web W and the second pressurizing unit 150 is arranged on the downstream side in the transfer direction of the web W.

The first pressurizing unit 120 has a separation layer and heats the web. Then, fibers which are included in the web W are bonded using the resin. The first pressurizing unit 102 of the present embodiment has a plurality of pairs of heating rollers 121 in the transfer direction of the web W. In detail, the first pressurizing unit 120 is configured by a first heating unit 120*a* and a second heating unit 120*b*. Then, the first heating unit 120*a* is arranged on the upstream side in the transfer direction of the web W and the second heat unit 120*b* is arranged on the downstream side in the transfer direction of the web W.

Then, as shown in FIG. 2, each of the first heating unit 120*a* and the second heating unit 120*b* are provided with a pair of heating rollers 121. The heating rollers 121 are provided with, for example, a metal core 125 such as aluminum, iron, or stainless steel and a heating member 126 such as a heater is provided in a central section of the metal core 125. Then, it is possible to heat and pressurize the web W which is being transferred by the web W being passed through between the pairs of heating rollers 121. Then, it is easy for the resin to melt and the fibers to become entangled as well as shorten the gaps between fibers and increase the points of contact between fibers by heating and pressurizing the web W using the pairs of heating rollers 121. Due to this, the strength of the web W is improved by increasing the density. Furthermore, in the present embodiment, by providing the first and the second heating units 120*a* and 120*b* at two locations, it is possible to ensure sufficient time for heating and pressurizing and it is possible to reliably improve the strength of the web W. Furthermore, the pressurizing force with regard to the web W from the heating rollers 121 of the second heating unit 120*b* which is arranged on the downstream side in the transfer direction of the web W is set to the larger than the pressurizing force with regard to the web W from the heating rollers 121 of the first heating unit 120*a* which is arranged on the upstream side in the transfer direction of the web W. Due to this, it is possible to suppress stretching of the web W which is being pressurized and to smoothly perform transferring of the web W since the pressurizing force with regard to the web W is gradually increased. In addition, due to the pressurizing units 120 being configured as the heating rollers 121, it is possible to form a sheet while continuously transferring the web compared to a case where the pressurizing units 120 are configured as a pressing apparatus with a plate shape. In a case where a pressing apparatus with a plate shape is used, a buffer unit, where the web which is being transferred in temporarily held, is necessary between pressings. That is, it is possible to reduce the size of the configuration of the entirety of the sheet manufacturing apparatus 1 by using the heating rollers 121.

In addition, the heating rollers 121 have a separation layer 127. In detail, the separation layer 127 is provided on the outer circumference surface of the metal core 125. It is possible to apply a layer which includes fluorine such as PFA (tetrafluoroethylene-perfluoroalkylvinylether copolymer) or PTFE (polytetrafluoroethylene (tetrafluoride)) and which is a tube or the like as the separation layer 127, and the tube containing fluorine is provided on the outer circumference of the metal core 125. Here, the separation layer 127 may be formed by carrying out a fluorine coating such as FIFE on the outer circumference surface of the metal core 125. Due to this configuration, it is possible to smoothly transfer the web W without the web W becoming attached to the heating rollers 121 since the web W and the separation layers 127 on the heating rollers 121 come into contact when the web W is heated and pressurized by the heating rollers 121. In addition, an elastic layer may be provided using silicon rubber or fluorine rubber between the metal core 125 and the separation layer 127. By providing the elastic layer, it is possible to increase the width of the transfer direction component (nip width) of a portion where the heating rollers 121 come into contact with each other and to efficiently transfer heat of the heating rollers to the web W.

The second pressurizing unit 150 is arranged on the downstream side of the first pressurizing unit 120 (the first and the second heating units 120*a* and 120*b*) in the transfer direction of the web W. The second pressurizing unit 150 is a unit which does not have a separation layer and does not heat the web W. The second pressurizing unit 150 is not provided with a heating unit such as a heater. That is, the second pressurizing unit 150 of the present embodiment is a cooling unit (the second pressurizing unit will be described below as the cooling unit 150). The cooling unit 150 of the present embodiment is provided with a pair of cooling rollers 151. Accordingly, the cooling unit 150 cools the web W and pressurizes the web W. Then, the cooling unit 150 has a function of lowering the temperature of the web W and improving the strength of the web W. The cooling rollers 151 have, for example, an air cooling mechanism which is provided with a hollow metal core 155 such as aluminum, iron, or stainless steel and an air injecting unit which injects air into the hollow section of the metal core 155. Due to this, there is a configuration where the temperature of the cooling rollers 151 is not raise to be equal to or more than the temperature of the web W which is heated when coming into contact with the web W which is heated by the first and the second heating units 120*a* and 120*b*. In addition, the web W passes through the cooling unit 150 with a temperature which is higher than the temperature of the surroundings of the cooling unit 150 which is the second pressurizing unit. There is a configuration where the heat is released from the web W via the cooling rollers 151 and the temperature of the web W approaches room temperature due to the cooling rollers 151 and the web W coming into contact. Due to this, fibers are reliably bonded to each other through the resin due to the web W being cooled and the melted resin hardening by being cooling. Here, the cooling system of the present embodiment is not limited to the cooling unit 150 and cooling is not necessary as long as heating is properly performed. In a case of cooling, for example, a water cooling system may be used. In addition, a rust proofing process such as electroless nickel plating may be carried out on the surface of the cooling rollers 151.

As described above, the first pressurizing unit 120 and the second pressurizing unit 150 (the cooling unit 150) are provided in the present embodiment, and the pressurizing force from the first pressurizing unit 120 is set to be smaller than the pressurizing force from the second pressurizing unit 150 (the cooling unit 150). In the present embodiment, out of the first heating unit 120*a*, the second heating unit 120*b*, and the cooling unit 150, the pressurizing force from the cooling unit 150 is the largest, the pressurizing force from the second heating unit 120*b* is the next largest, and the pressurizing force from the first heating unit 120*a* is the smallest. Due to this configuration, it is possible to transfer the web W without becoming attached to the heating rollers 121 of the first and the second heating units 120*a* and 120*b* when the web W is heated and pressurized since the pressurizing force from the first pressurizing unit 120 (the first and the second heating units 120*a* and 120*b*) is small compared to the pressurizing force from the cooling unit 150. On the other hand, it is possible to compensate for insufficient pressurizing due to the first and the second heating units 120*a* and 120*b* by the pressurizing force being large without heating in the cooling unit 150. In addition, in the cooling unit 150, it is possible to not have a separation layer since there is no heating and it is possible for high pressures to be endured.

A second cutting unit 130, which cuts the web W along the transfer direction of the web W, is arranged on the downstream side of the cooling unit 150 in the transfer direction. The second cutting unit 130 is provided with a cutter and cuts the web W according to a predetermined cutting position in the transfer direction of the web W. Due to this, the sheet Pr (the web W) is formed in a desired size. Then, the sheet Pr (the web W) which is cut is stacked in the stacker 160 or the like.

According to the embodiment described above, it is possible to obtain the following effects.

The web W which is formed using the web forming unit 70 is cut into sheet shapes by the first cutting unit 110, and after this, is first heated and pressurized by the first heating unit 120*a*, and then, is first heated and pressurized by the second heating unit 120*b*, and is next pressurized by the cooling unit 150. Here, the pressurizing force from the first and the second heating units 120*a* and 120*b* is set to be smaller than the pressurizing force from the cooling unit 150. In addition, it is possible to transfer the web W without becoming attached to the heating rollers 121 since the separation layers 127 are formed on the surfaces of each of the heating rollers 121 of the first and the second heating units 120*a* and 120*b*. In addition, it is possible to reduce the burden on the separation layers 127 since the pressurizing force is relatively small. Then, it is possible to compensate for insufficient pressurizing due to the first and the second heating units 120*a* and 120*b* by the pressurizing force being large without heating in the cooling unit 150. In addition, it is possible for high pressures to be endured since there is no separation layer in the cooling unit 150.

Here, the sheet according to the present embodiment is mainly referred to as a sheet with a sheet shape where the raw material is fibers. However, the sheet is not limited to this and may be a board shape or a web sheet (or a shape with irregularities). In addition, the sheet may be use plant fibers such as cellulose, chemical fibers such as PET (polyethylene-telephthalate) or polyester, or animal fibers such as wool or silk as raw materials. The sheet in the present application can be divided into paper or nonwoven material. Paper includes fresh pulp or used paper as raw materials, includes formats such as thin sheet shapes, and includes recording paper, wall paper, wrapping paper, colored paper, drawing paper, and the like with the aim of writing or printing. Nonwoven material includes nonwoven material, fiber board, tissue paper, kitchen paper, cleaning paper, filters, liquid absorbing materials, sound absorbing bodies, shock absorbing materials, mats, and the like with greater thickness and lower strength compared to paper.

The present invention is not limited to the embodiment described above and various modifications and alterations may be added to the embodiment described above. Modified examples are described below.

Modified Example 1

There is a configuration in the embodiment described above where the first cutting unit 110 is arranged on the downstream side of the transfer belt 101 of the transferring unit 100, but the configuration is not limited to this. For example, a preliminary heating unit, which preliminarily heats the web W with a lower temperature or a lower load on the web W than the first and the second heating units 120*a* and 120*b*, may be arranged on the upstream side of the first cutting unit 110 in the transfer direction of the web W. In this case, a configuration is possible where the preliminary heating unit is provided with a pair of heating and pressurizing rollers. Heating members such as heaters are provided in central sections of rotation shafts of the heating and pressurizing rollers and it is possible to heat and pressurize the web W which is being transferred by the web W being passed through between the pair of heating and pressurizing rollers. Due to this, the strength of the web W is increased. Then, the web W which passes through the preliminary heating unit is cut using the first cutting unit 110. That is, it is possible to suppress the web W from breaking down or the like during cutting and to accurately cut the web W since it is possible to cut the web W in a state where the web W is stronger.

Modified Example 2

There is a configuration in the embodiment described above where the first and the second heating units 120*a* and 120*b* are arranged as the first pressurizing unit 120, but the configuration is not limited to this. For example, there may be a configuration where only the first heating roller 120*a* is arranged or there may be a configuration where three or more of the first pressurizing units 120 are arranged. In this case, the first pressurizing unit 120 is appropriately set according to the thickness, material properties, and the like of the web W (the sheet Pr) which is being manufactured. By doing this, it is possible to effectively manufacture (form) the sheet Pr (the web W).

Modified Example 3

There is a configuration in the embodiment described above where the first pressurizing unit 120 and the second pressurizing unit 150 have the format of pairs of rollers, but the configuration is not limited to this. For example, there may be a configuration with plate pressing device. Even with this, it is possible to obtain the same effects as described above.

Modified Example 4

The first cutting unit 110 is arranged on the upstream side of the first heating unit 120*a* in the embodiment described above, but the configuration is not limited to this. For example, the first cutting unit 110 may be arranged on the downstream side of the cooling unit 150. In this case, the first cutting unit 110 is arranged on the downstream side of the cooling unit 150 and the second cutting unit 130 is arranged on the downstream side of the first cutting unit 110. By doing this, it is possible to increase precision of the dimensions of the web W (the sheet Pr) since the web W is cut after being heated, pressurized, and cooled. In addition, the first cutting unit 110 may be arranged between the first heating unit 120*a* and the second heating unit 120*b*. By doing this, the strength of the web W is improved using the first heating unit 120*a* and it is possible to suppress the web W from breaking down or the like during cutting and to accurately cut the web W since the web W is cut in this state.

Modified Example 5

The apparatus in the embodiment described above is described as forming the web with a dry type, but the configuration is not limited to this. For example, the web may be formed with a moist system and the portion where the web is finally heated and pressurized may be as in the present application.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A sheet manufacturing apparatus comprising:

a web forming unit configured to form a web which includes fibers and resin; and a first pressurizing unit and a second pressurizing unit configured to pressurize the web, the first pressurizing unit having a separation layer, the first pressurizing unit being positioned on an upstream side of the second pressurizing unit in a transfer direction of the web, the first pressurizing unit being configured to heat the web, the second pressurizing unit positioned on a downstream side of the first pressurizing unit in the transfer direction of the web, the second pressurizing unit having no separation layer, the second pressurizing unit being configured not to heat the web, a pressurizing force from the first pressurizing unit being smaller than a pressurizing force from the second pressurizing unit.

2. The sheet manufacturing apparatus according to claim 1, wherein the first pressurizing unit has a plurality of pairs of heating rollers in the transfer direction of the web, and a pressurizing force relative to the web from the heating rollers on the downstream side is larger than a pressurizing force relative to the web from the heating rollers on the upstream side.

3. The sheet manufacturing apparatus according to claim 1, wherein the separation layer is a layer which includes fluorine.

4. The sheet manufacturing apparatus according to claim 1, further comprising a cutting unit configured to cut the web on the upstream side of the first pressurizing unit in the transfer direction.

* * * * *